US005350600A

United States Patent [19]

Kubota

[11] Patent Number: 5,350,600

[45] Date of Patent: Sep. 27, 1994

[54] APPARATUS FOR APPLYING A VISCOUS LIQUID MATERIAL AND METHOD OF CONTROLLING APPLICATION THEREOF

[75] Inventor: Yoshimichi Kubota, Tokyo, Japan

[73] Assignee: Three Bond Co., Ltd., Tokyo, Japan

[21] Appl. No.: 928,271

[22] Filed: Aug. 11, 1992

[30] Foreign Application Priority Data

Sep. 9, 1991 [JP] Japan ..... 3-228936

[51] Int. Cl.[5] ..... B05D 5/00; B05B 3/00

[52] U.S. Cl. ..... 427/256; 118/323; 118/696; 118/301; 65/43; 427/64; 427/284; 427/421

[58] Field of Search ..... 427/64, 421, 165, 284, 427/287, 256; 118/669, 696, 300, 323, 301; 251/58, 326; 222/504, 559, 561; 65/43; 156/107

[56] References Cited

U.S. PATENT DOCUMENTS

| | | | |
|---|---|---|---|
| 2,837,242 | 6/1958 | McLaughlin | 222/561 |
| 3,492,146 | 1/1970 | Kornaker | 65/43 |
| 3,779,424 | 12/1973 | Shapland | 222/561 |
| 4,137,341 | 1/1979 | Adachi | 118/323 |
| 4,234,372 | 11/1980 | Bernard et al. | 118/323 |
| 4,262,036 | 4/1981 | Mineyama et al. | 118/323 |
| 4,482,579 | 11/1984 | Fujii et al. | 118/323 |
| 4,576,113 | 3/1986 | Kambara et al. | 118/323 |

FOREIGN PATENT DOCUMENTS

| | | | |
|---|---|---|---|
| 541914 | 4/1956 | Italy | 222/561 |
| 1186532 | 7/1989 | Japan | 427/64 |

*Primary Examiner*—Joseph W. Drodge
*Attorney, Agent, or Firm*—Samuels, Gauthier & Stevens

[57] ABSTRACT

Disclosed is an apparatus for applying a viscous liquid material and a method of controlling the discharge of the viscous liquid material. The apparatus has a movable nozzle having a port for discharging the viscous liquid material in a predetermined discharging direction. The nozzle is movably arranged to controllably trace a predetermined track. A shutter for controllably closing the port of the nozzle includes a shiftable member arranged on the port to move relative to the port between a first position and a second position along a plane which crosses the discharging direction of the nozzle so that the shiftable member release and covers the port of the nozzle. The present invention is suitable for application on a loop track or a closed path. In the method, it is preferred that the first position is located on the front side of the second position facing toward a direction in which the nozzle advances at termination of tracing with the viscous liquid material.

15 Claims, 15 Drawing Sheets

APPARATUS FOR APPLYING A VISCOUS LIQUID MATERIAL AND METHOD OF CONTROLLING APPLICATION THEREOF

BACKGROUND OF THE INVENTION

1. Field of the Invention

The present invention relates to an apparatus for applying a viscous liquid material, in particular, to an apparatus for injecting a viscous liquid material such as an adhesive with following a predetermined track on a surface of an object to be applied, and relates to a method of controlling application in an application apparatus.

2. Description of the Prior Art

Conventionally, work steps of applying a viscous liquid material such as an adhesive and the like have been utilized in various manufacturing processes in such a way to draw a line or a band with the viscous material on a surface to be applied, following a predetermined track. Specifically, in a process for assembling automobiles, a liquid rubber called a sealant is applied to the periphery of a sheet glass, and it is then pressed to a window panel at a normal temperature, thereby the sheet glass is adhered to the window. For another example, in assembly of picture tubes for a television set, a frit is applied to a joint surface at the brim of a coned funnel, and a front grass is then mounted on the brim of the coned funnel to be adhered by baking at a temperature of about 450° C. As illustrated above, the apparatus for applying a viscous liquid material have been widely utilized in the industrial field.

The apparatuses which have been conventionally utilized for applying a viscous liquid material can be generally classified into three types, that is, a valved-tank type, a type of having a pressured tank and a separate valve, and a type of pumping to a separate valve.

FIG. 1 shows a construction of a valved-tank type frit application apparatus. In the frit application apparatus of FIG. 1, a large tank 1 containing a frit, whose capacity is rather large, for example, about 2 liters, is located with a robot hand (not shown) above a funnel 2 whose surface to be applied is faced upwards toward the tank 1. The tank 1 has a nozzle 3 at a bottom end thereof, and the tank 1 is moved by the robot hand so that the nozzle 3 traces on an application track, that is, the brim of the funnel. Inside the tank 1, a needle valve 4 is arranged to be axially moved downwards by a piston device 5, so that a tip end of the needle valve seats on a valve seat 4*a* to close the nozzle 3. Moreover, a blade 7 which is driven by an actuator 8 is provided inside the tank 1 in order to agitate the frit. On the other hand, a tube is provided on the tank 1 in order to apply an air pressure to inside of the tank 1 at a preset level of 0.2 to 0.5 kg/cm$^2$. A sensor 9 is provided for detecting a initial point at which a band of the frit applied on the funnel begins on the surface.

According to the above construction, the needle valve 4 opens the nozzle 3 to apply the frit to the brim, while it travels along the brim of the funnel. Near the termination of the application along the brim, the initial portion of the frit band is detected by the sensor 9, and the needle valve 4 is then closed so that application of the frit is stopped at the initial point, thereby achieving a cycle of frit application.

However, in the apparatus described above, the tank 1 has large weight and high inertia. Therefore, correctness of the operation of the tank 1 by using the robot arm tends to decrease. Moreover, it is very difficult to control a volume of the injected frit by regulating the needle valve 4 which is moved downwards at the termination of the application in response to detection of the initial portion of the applied frit band. In particular, at closing of the needle valve 4, the frit between the needle valve 4 and the valve seat 6 is forced out of the nozzle 3 by the needle valve 4, so that the band drawn with the applied frit is suddenly swelled at a site A ahead the terminal point, which should meet the initial point, as shown in FIG. 2, and the band becomes extremely poor just behind the site A. Therefore, uniformity of the frit band deteriorates near the terminal point. Accordingly, it may cause incomplete adherence between the glass and the funnel assembled, which results in production of sub-standard articles, low reliability of the product and the like.

FIG. 3 shows a construction of a frit application apparatus of a type of having a pressured tank and a separate valve. In this apparatus, a frit which is enclosed in a main tank 10 and agitated with a blade 7 rotatively driven by an actuator 6 is pressed by an air pressure to be fed through a gate valve 11 and a flexible connecting tube 12 to a valve device 13 which is provided separately from the main tank 10. The valve device 13 is arranged to be moved by a robot arm (not shown) and the like above a surface to be applied of the funnel 2. In accordance with the above construction, the valve device 13 travels on an application track, while the valve is operated to open, thereby achieving frit application.

However, in this apparatus, since the frit is fed through the flexible connecting tube 12, the pressure applied on the frit decreases from a value Pt at the tank 10 down to a value Pi at an injection port of the valve device 13 according to the distance from the tank 10 as shown in FIG. 4. Therefore, it is rather difficult to control the injection pressure Pi. In addition, since the injection pressure Pi also easily changes in response to the travelling movement of the valve device 13, the frit applied to the funnel forms an uneven band 14 as shown in FIG. 5. Moreover, according to sudden pressure change at the gate valve 11, some component blended in the frit sometimes separates from the frit in the connecting tube 12, etc., the frit cannot be applied, accordingly, in a normal condition.

FIG. 6 shows a construction of a frit application apparatus of a type of pumping to a separate valve. In this apparatus, in place of a gate valve 12 of the apparatus shown in FIG. 3, a screw pump 15 is utilized for forcingly feeding the frit to the valve device 12. Therefore, this apparatus can avoid the frit separation caused by pressure decrease at the gate valve illustrated above. However, since the frit feeding method of this apparatus is basically the same as that of the apparatus shown in FIG. 3, the injection pressure at the valve device 13 cannot be controlled to fluctuate unstably. Therefore, the frit applied on the funnel 2 similarly draws a non-uniform band such as shown in FIG. 5.

Of course, in a process for applying a sealant to a sheet glass, the same problems as illustrated above similarly arises as frequently as in that for a frit application to a funnel described above.

Consequently, the conventional apparatuses for applying a viscous liquid material have various problems to be solved such as incorrect positioning due to weight and inertia of a large-volume tank, difficulty in control of an applied volume, unevenness of the band traced with the applied liquid material, component separation of the frit, etc. In other words, it is difficult to apply a viscous liquid material uniformly with high reliability.

SUMMARY OF THE INVENTION

With these problems in mind, therefore, it is the primary object of the present invention to provide a novel apparatus for applying a viscous liquid material which can correctly and uniformly apply the liquid material.

It is a further object of the present invention to provide, an apparatus for applying a viscous liquid material, comprising a nozzle having a port for discharging the viscous liquid material in a predetermined discharging direction, and the nozzle being movably arranged to controllably trace with the viscous liquid material on a predetermined track, a method of controlling discharge of the viscous liquid material so that discharge can be uniformly and acurately performed.

In order to achieve the above-mentioned object, an apparatus for applying a viscous liquid material according to the present invention comprises: a nozzle having a port for discharging the viscous liquid material in a predetermined discharging direction, the nozzle being movably arranged to controllably trace with the viscous liquid material on a predetermined track; and a shutter for controllably closing the port of the nozzle, the shutter including a shiftable member arranged on the port to move relative to the port between a first position and a second position along a plane which crosses the discharging direction of the nozzle so that the shiftable member release the port of the nozzle at the first position and covers the port at the second position.

A method of controlling discharge of the viscous liquid material according to the present invention comprises: arranging a shiftable member on the port to move relative to the port between a first position and a second position along a plane which crosses the discharging direction of the nozzle and contains a first position in which the shiftable member release the port of the nozzle and a second position in which the shiftable member covers the port; and moving the shiftable member between the first position and the second position to regulate the discharge.

The apparatus and method described above are suitable for application of a viscous liquid material, in particular, on a loop track or a closed path.

BRIEF DESCRIPTION OF THE DRAWINGS

The features and advantages of the apparatus for applying a viscous liquid material according to the present invention over the proposed will be more clearly understood from the following description of the preferred embodiments of the present invention taken in conjunction with the accompanying drawings in which like reference numerals designate the same or similar elements or sections throughout the figures thereof and in which.

DETAILED DESCRIPTION OF THE PREFERRED EMBODIMENTS

Figure 1:
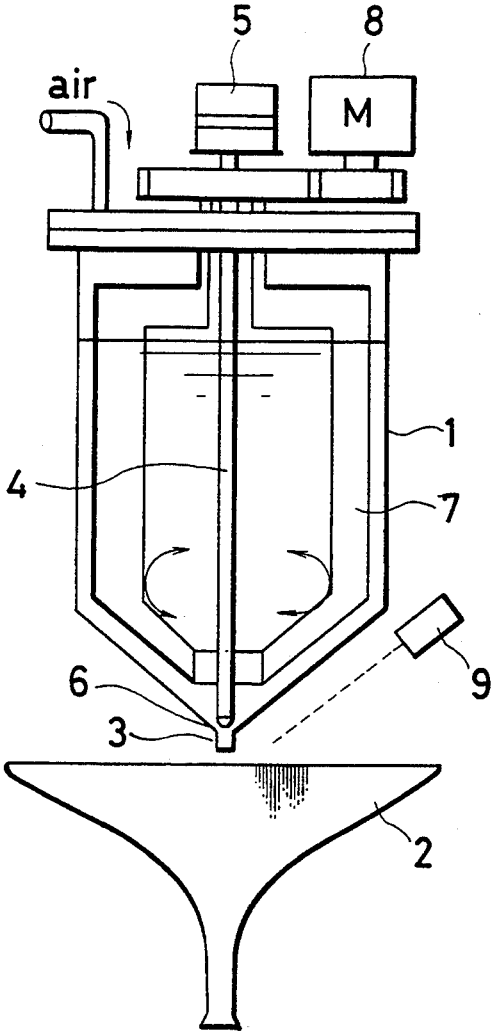
FIG. 1 PRIOR ART
FIG. 1 is an explanatory view showing a prior art apparatus for applying a frit.

Referring now to the drawings, preferred embodiments of the apparatus for applying a viscous liquid material according to the present invention will be described.

Figure 7:
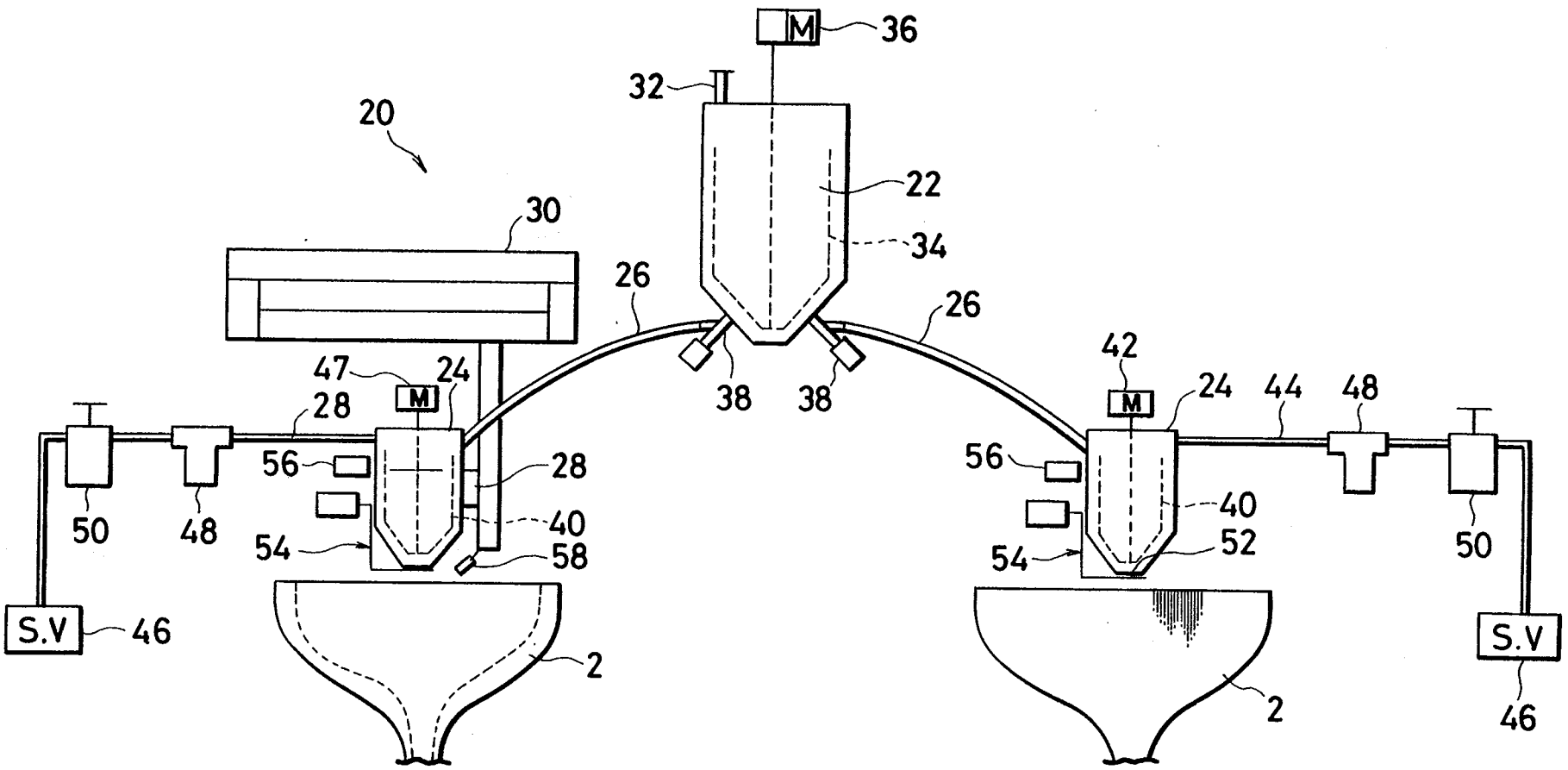
FIG. 7 is an explanatory view showing an embodiment of the apparatus for applying a viscous liquid material according to the present invention.

FIG. 7 is an explanatory view generally showing a systemic construction of an embodiment of the apparatus for applying a viscous liquid material according to the present invention. The apparatus 20 of this embodiment is illustrated as a frit coater, and it includes a main tank 22 and two sub-tanks 24 each of which is connected to the main tank 22 through a flexible tube 26, respectively, in order that a viscous liquid material, specifically, a frit in this embodiment, can be distributedly applied to two objects, or two funnels 2, at a time. Of course, the apparatus may include only one sub-tank. The main tank 22 has a large capacity for storing a sufficient amount of the frit, for example, about 50 liters. On the other hand, the sub-tank 24 has a rather small capacity such that only an amount of frit which is necessary for application treatment to one object to three objects to be applied can be contained.

Each of the sub-tank 24 is supported by a movable hand 28 which is operated by a robot 30 (these of the right side sub-tank unit are omitted from the drawing) above each of production lines (not shown) which runs along a direction perpendicular to the plane of the drawing in this embodiment and transports funnels 2 to be applied to a location under the sub-tank 28. The sub-tank 24 moves with the hand 28 relative to an applied surface of the funnel 2 in order to draw a band of frit on the surface to be applied, with being controlled by the robot 30. Of course, if necessary, the production lines can be modified so that the funnel also can move for application treatment.

An air line pipe 32 is provided on the main tank 22 for pressuring the frit inside thereof to feed the frit to the sub-tanks 24 through the tubes 26. Moreover, inside the main tank 22 provided is an agitating blade 34 which is rotated by drive of a motor 36. At a bottom of the main tank 22, each of two control valves 38 are arranged between each of the tubes 26 and the main tank 22, respectively.

Inside of each of the sub-tanks 24 provided is an agitating blade 40 which is rotated by an actuator 42 such as a motor. Moreover, each of the sub-tank 24 is connected by a line tube 44 to a solenoid valve 46 through a vaporizing tank 48 for supplying an atmosphere of vaporized solvent and a regulator 50, so that a vaporized solvent is fed into the sub-tank 24 to pressure the frit at a preset pressure level, being controlled by the regulator 50. Moreover, at a bottom of each of the sub-tanks 24, an injection port 52 for discharging the frit from the sub-tank 24, details of which will be described hereinafter, is formed respectively, and a shutter device 54 is arranged on the sub-tank 24 so as to open and close the injection port outside the sub-tank 24. According to this construction, if the shutter device 54 opens the injection port 52, the frit is injected, being pressed out by the preset level of vapor pressure. Moreover, a level sensor 56 is provided on each of the sub-tank 24 on the side thereof, and the level sensor 56 sends information concerning the frit level in the sub-tank 24 to the corresponding control valve 38 so that, if the frit level in either of the sub-tanks 24 falls down to a predetermined level, the corresponding control valve 38 opens to supply the frit from the main tank 22 to the sub-tank 24. Outside of each of the sub-tank 24 near the injection port 52, a sensor 58 (this for the right side unit is omitted from the drawing) is arranged for detecting an initial point of the frit band drawn on the funnel 2 during the application treatment, details of which will be described hereinafter.

Figure 8:
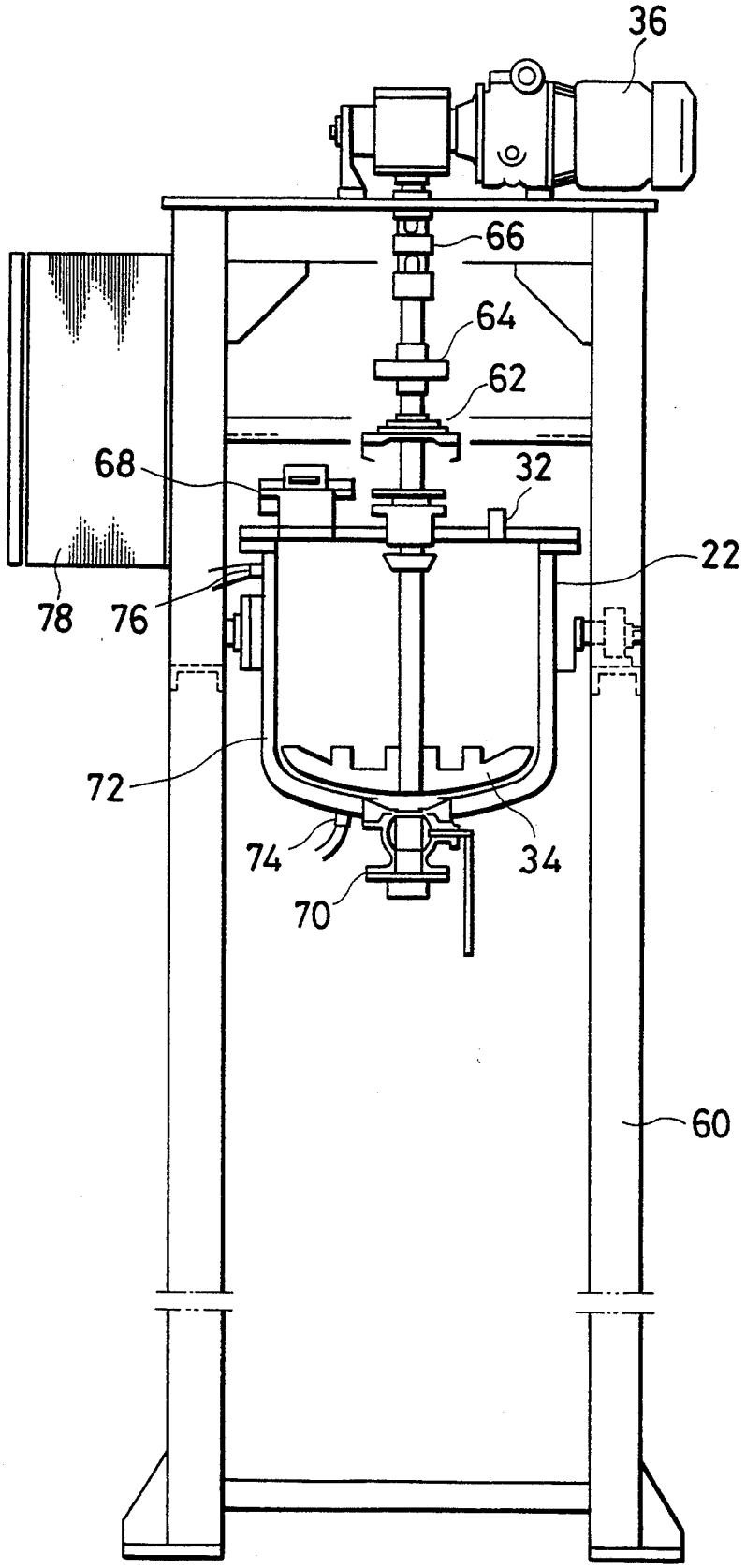
FIG. 8 is a partly sectional schematic view showing a main tank of the apparatus according to the present invention.

FIG. 8 shows details of the main tank 22. The main tank 22 is supported by a frame 60. The motor 20 is fixedly mounted on the upper portion of the frame 60 and connected to the agitating blade 34 through a bearing unit 62 which is fixed with the frame 60, a transmission part 64 and a universal joint 66. The main tank 22 has a window 68 on the top thereof, through which the frit is supplied into the tank 22. It can also serve as a observation hole. Moreover, a leak valve and a pressure indicator (not shown) are arranged on the main tank 22. The main tank 22 also includes a distributor 70 which is connected to the control valves 38 and the tubes 26. In order to maintain the temperature of the frit in the main tank 22 at a predetermined level, the main tank 22 is covered with a thermostatic chamber 72 in which isothermic water is fed from an inlet tube 74 to an outlet tube 76. The numeral 78 depicts a control panel.

According to the above construction, a frit which is supplied from the window 68 into the main tank 22 is agitated by the blade 34, while its temperature is maintained to the predetermined level by the water supplied from the inlet tube 74 to the thermostatic chamber 72. Supply of the frit from the main tank 22 into either of the sub-tanks 24 is controlled by operating the corresponding control valve 38 appropriately in accordance with information given from each side of the sub-tanks for requesting frit supply. For the supply to the sub-tanks, there may arises a slight deterioration of the feeding pressure due to employment of the flexible tubes 26 for connection. Nevertheless, it does not cause any problem about frit application at the injection ports, because the frit is further pressured in each of the sub-tanks 24. Moreover, In the present invention, since the pressure applied to the frit in the main tank 22 can be decreased to a level such as being required only for feeding the frit from the main tank 22 to the sub-tanks 24, it can avoid excess load and a large decrease of the pressure at the valve 38 which may badly affect the frit.

Figure 9:
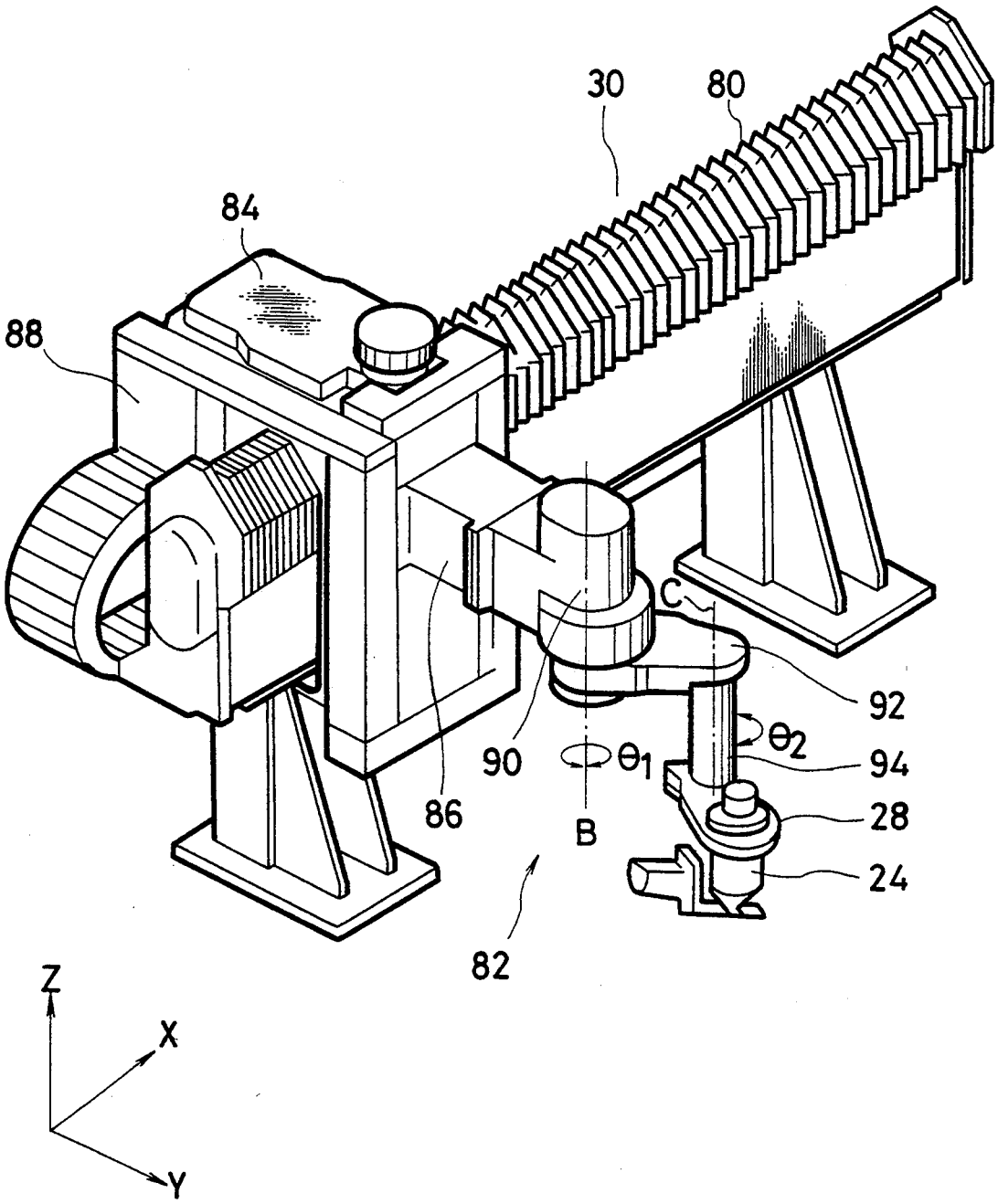
FIG. 9 is a perspective Illustration showing a robot with a movable hand.

FIG. 9 shows the robot 30 with the movable hand 28 in detail. The robot 30 comprises an X-axis displacement unit 80, Y-axis displacement unit 82 and a Z-axis displacement unit 84 for operating the hand 28 in three dimensional movement. The hand 28 which holds the sub-tank 24 is connected through the Y-axis displacement unit 82 to a support arm 86, and the arm 86 is supported on a body 88 in such a manner that the arm can be shifted by the Z-axis displacement unit 84 along a vertical direction which is illustrated by an arrow Z in FIG. 9. The body 88 is mounted on the X-axis displacement unit 80 so as to be movable along a horizontal direction which is shown by an arrow X in FIG. 9. The Y-axis displacement unit 82 includes first, second and third parts 90, 92 and 94. The first part 90 is fixed to the arm 86, and the second part 92 which extends horizontally is connected to the first part 90 at a base portion thereof in such a manner that the second part 92 can rotate relative to the first part 90 with respect to a rotational axis B which is parallel to the direction Z. The third part 94 extending vertically is connected at one end thereof to a tip portion of the second part 92 rotatably with respect to a rotational axis C which is also parallel to the direction Z, and the hand 28 is fixed to the other end of the third part 94 and extends horizontally. Accordingly, an amount of Y-directional displacement of the sub-tank 24 can be preferably regulated by appropriately controlling a rotation angle $\theta_1$ of the second part 92 and a rotation angle $\theta_2$ of the third part 94 and the hand 28.

According to the above construction, the robot 30 can voluntarily shift the position of the sub-tank 24 above a funnel. Moreover, the robot can be operated under computer-automated control in order to automatically and cyclically repeat a predetermined stroke of application such as a round stroke of frit coating along a brim of a funnel and the like.

Figure 10:
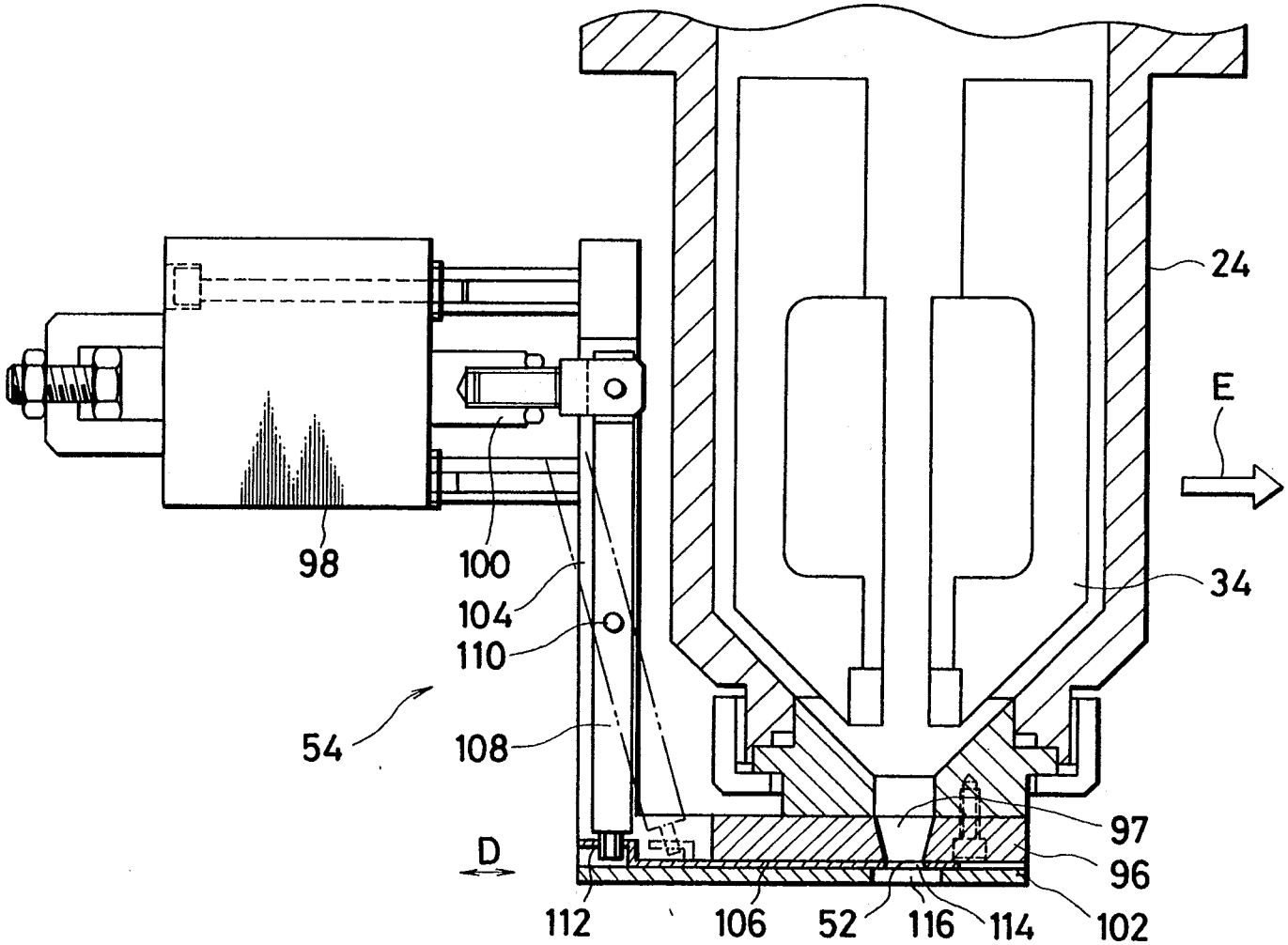
FIG. 10 is a sectional view showing a first embodiment of a sub-tank and a shutter device of the apparatus according to the present invention.

FIG. 10 illustrates a set of the sub-tank 24 and the shutter device 54 in detail. In regard to the sub-tank 24, a nozzle member 96 with a nozzle hole 97 which is narrowed to the injection port 52 is fitted on the bottom of the sub-tank 24 with a screw, so that frit charged to the sub-tank 24 is vertically injected through the nozzle hole 97 out of the injection port 52.

On the other hand, the shutter device 54, which is set beside the sub-tank 24 so as to accompany the sub-tank 24 for application operation, comprises an air cylinder device 98 with a piston rod 100 which can move in a horizontal direction. A guide plate 102 is fixedly connected to the air cylinder 98 through a support member 104 so that the plate 102 is horizontally located below the sub-tank 24. A shutter plate 106 interposes between the nozzle member 96 and the guide plate 102 so as to slide on the guide plate 102. Moreover, a rod 108 is arranged on the support member 104 in such a manner that it can rotate with respect to a center 110 between the air cylinder 98 and the shutter plate 106. One end of the rod 108 is connected to the piston rod 100 and the other end is inserted in a hole 112 which is formed on an end portion of the shutter plate 106 so that, in response to reciprocal motions of the piston rod 100, the rod 108 swings to reciprocally slide the shutter plate 106 in a horizontal direction which is shown by an arrow D in FIG. 10.

The shutter plate 106 has a bore 114 whose dimension at the upper side of the plate 106 is preferably larger than that of the injection port 52 so as to smoothly pass the frit therethrough. However, it is of course possible to use a bore having the same size as that of the injection port at the upper side of the plate. Moreover, the dimension of the bore is increased at the lower side of the plate. The guide plate is provided with an aperture 116 at a location under the injection port 52, and the size of the aperture 116 is preferably larger than those of the injection port 52 and the bore 114 in order to easily pass the injected frit therethrough.

According to the above construction, if the piston rod 100 reciprocally moves, the shutter plate 106 reciprocally slides in the directions opposite to the motions of the piston rod. Accordingly, in FIG. 10, the bore 114 shifts between a position under the injection port 52 and a position on the right side of the injection port 52 in the drawing, thereby releasing and covering the injection port 52. Therefore, if the sub-tank is then moving in the direction shown by an arrow E in FIG. 10 along the sliding direction D of the shutter plate 106, the injection port is opened in accordance with a backward movement of the bore 114 and is closed with a forward movement.

Figure 11:
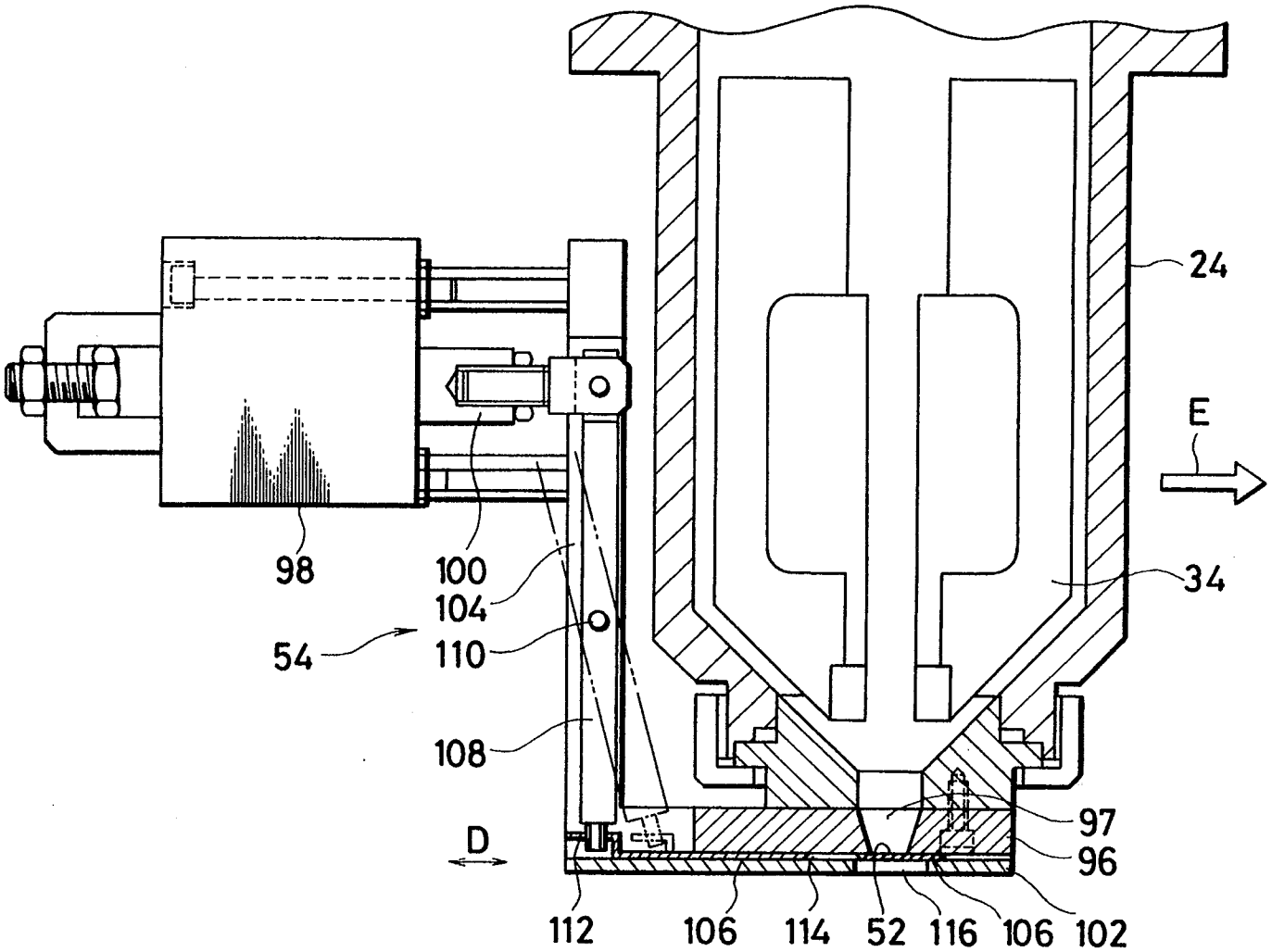
FIG. 11 is a sectional view showing a second embodiment of the sub-tank and the shutter device of the apparatus according to the present invention.

FIG. 11 shows a modified arrangement of the bore 114. In this embodiment, the bore 114 is located so that it reciprocates between a position under the injection port 52 and a position on the left side of the injection port 52 in the drawing. Therefore, if the sub-tank is then moving in the direction shown by an arrow E in FIG. 10, the injection port opens in accordance with a forward movement of the bore 114 and closes with a rearward movement. Of course, it is also possible to bring such an operation state by using the shutter device 54 of FIG. 10, if the sub-tank 24 of FIG. 10 is moved in a direction opposite to the direction E.

Figure 2:
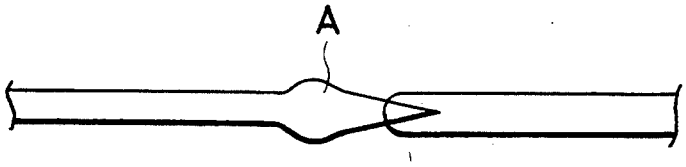
FIG. 2 PRIOR ART
FIG. 2 is a schematic view showing a frit applied by the apparatus of FIG. 1.
Figure 3:
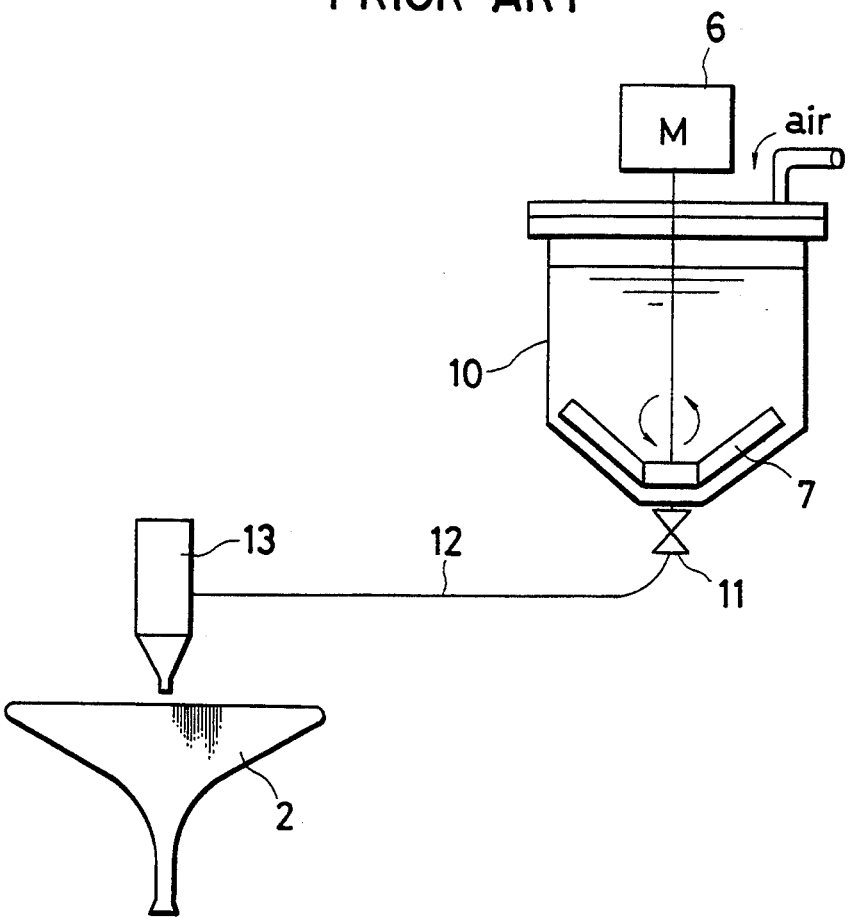
FIG. 3 PRIOR ART
FIG. 3 is an explanatory view showing another prior art apparatus for applying a frit.
Figure 4:
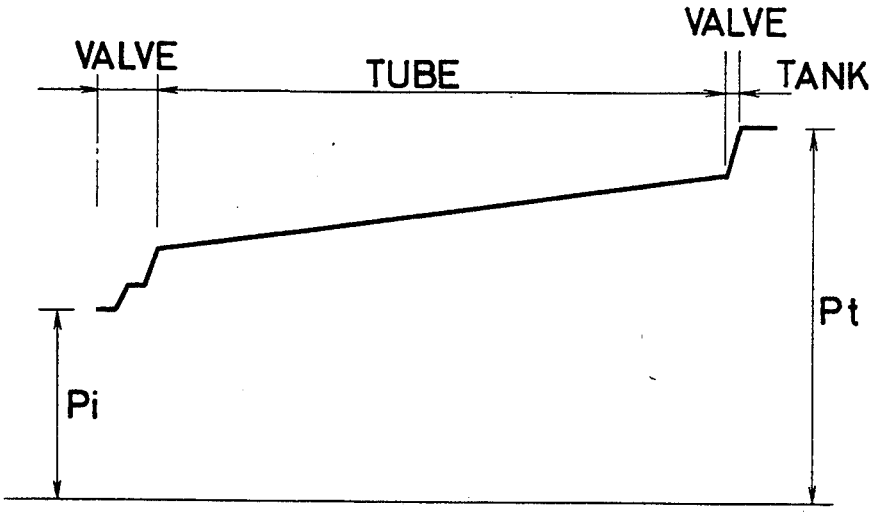
FIG. 4 PRIOR ART
FIG. 4 is a diagrammatic view showing a pressure decrease in the apparatus of FIG. 3.
Figure 5:
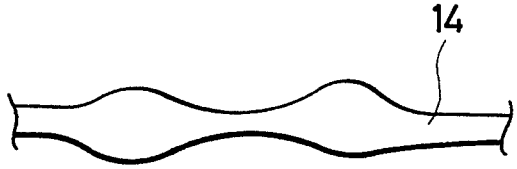
FIG. 5 PRIOR ART
FIG. 5 is a schematic view showing a frit applied by the apparatus of FIG. 3.
Figure 6:
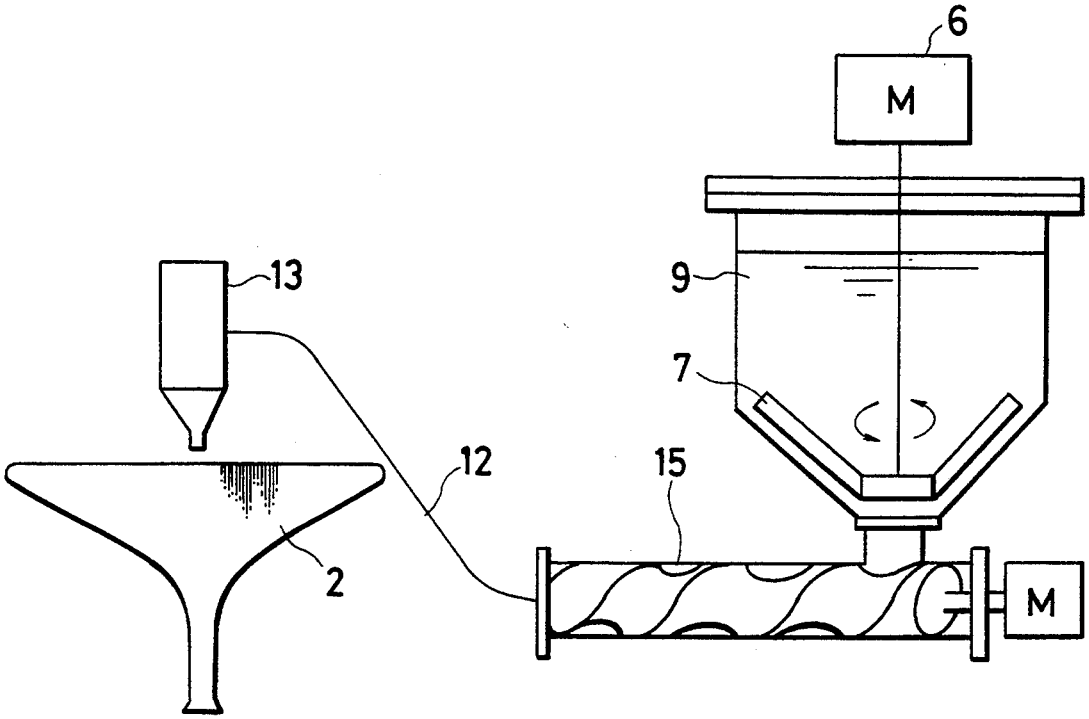
FIG. 6 PRIOR ART
FIG. 6 is an explanatory view showing a third prior art apparatus for applying a frit.

In the above embodiments, injection of the frit is stopped at the nozzle port 52 by a flat and thin shutter plate moving along a plane crossing the direction in which the frit is injected from the port, and the shutter plate breaks in and cuts off the corded frit injection like a knife. Therefore, It can prevent frit near the injection port from being undesirably forced out of the nozzle in such a manner that a valve body forces in the prior art apparatus which is shown in FIGS. 1 and 2 and described above. The direction in which the frit is injected can be altered as necessity arises, and an angle formed between the injection direction and the plane on which the shutter plate moves also may be changed. However, in view of equality of application efficiency in omnidirectional movement of the injection port, it is preferred that the injection is directed perpendicularly to the surface to be applied and the plane along which the shutter plate moves crosses the injecting direction perpendicularly. Therefore, in the above embodiments, the injected frit is directed to the vertical direction, and the shutter plate is arranged to move horizontally, namely perpendicularly to the injecting direction. Moreover, if necessary, it is also possible to use a curved shutter plate to slide on a plane curved correspondingly and cover the injection port.

Moreover, since the bore 114 is tapered toward the injection port 52 to form an acute edge like a knife around the bore 52 on the upper side of the shutter plate 106, the edge can sharply cut in the frit injected from the port 52 when the upper surface of the plate covers the injection port. Therefore, an amount of the injected frit can be accurately regulated.

Moreover, it is of course possible to use a shutter plate with no bore and arrange the shutter plate so as to cover the injection port at a peripheral end portion of the shutter plate. In this case, the peripheral portion is preferably edged with an acute angle in a manner similar to that described above. The edged periphery may be shaped to draw a curve such as an arc line and the like.

In each of the above embodiments, the air cylinder 98 is connected via a flexible hose to a solenoid valve device (not shown) for driving the air cylinder, thus the shutter plate 106 and the rod 108 are not directly driven by the solenoid valve device, but are indirectly driven via the air cylinder 98. The reason for this is because air cylinders are generally lighter in weight than solenoid valve devices, and also the moving velocity of the shutter plate 106 can be controlled easier by an air cylinder than by a solenoid valve device.

Figure 12:
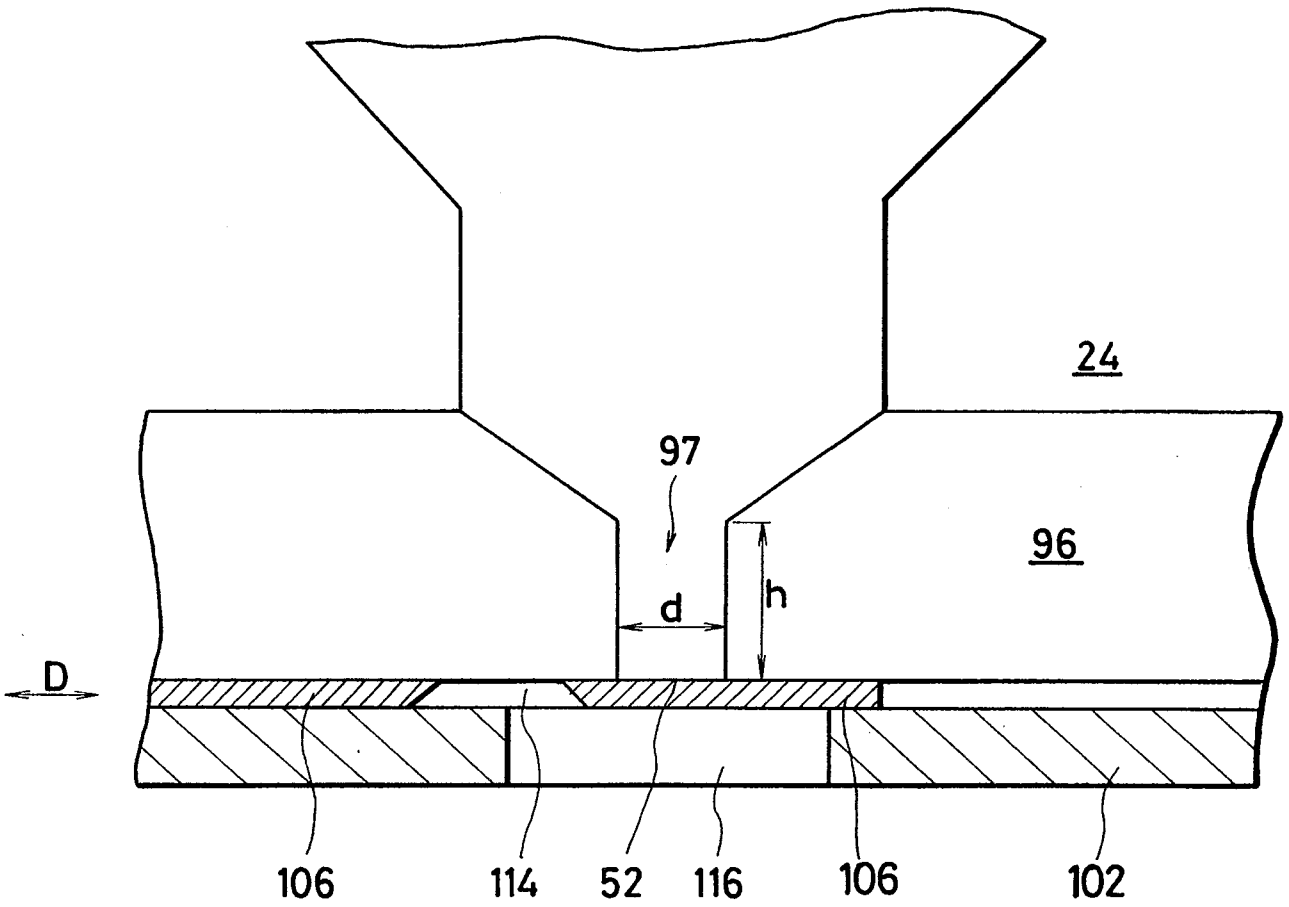
FIG. 12 is an enlarged sectional view showing an injection port of a sub-tank according to the present invention.

FIG. 12 shows a modification of the nozzle hole 97. In this embodiment, the nozzle hole 97 is formed so as to include a cylindrical pass vertically extending to the injection port 52 and having substantially the same diameter size d as that of the injection port 52. The length h of the cylindrical pass is larger than the diameter d. According to this construction, flow of the frit before injection is rectified to be uniformly introduced to the injection port 52. Therefore, due to the improvement of directionality of the frit flow, the direction in which the frit is injected from the injection port can be prevented from fluctuation.

Figure 13:
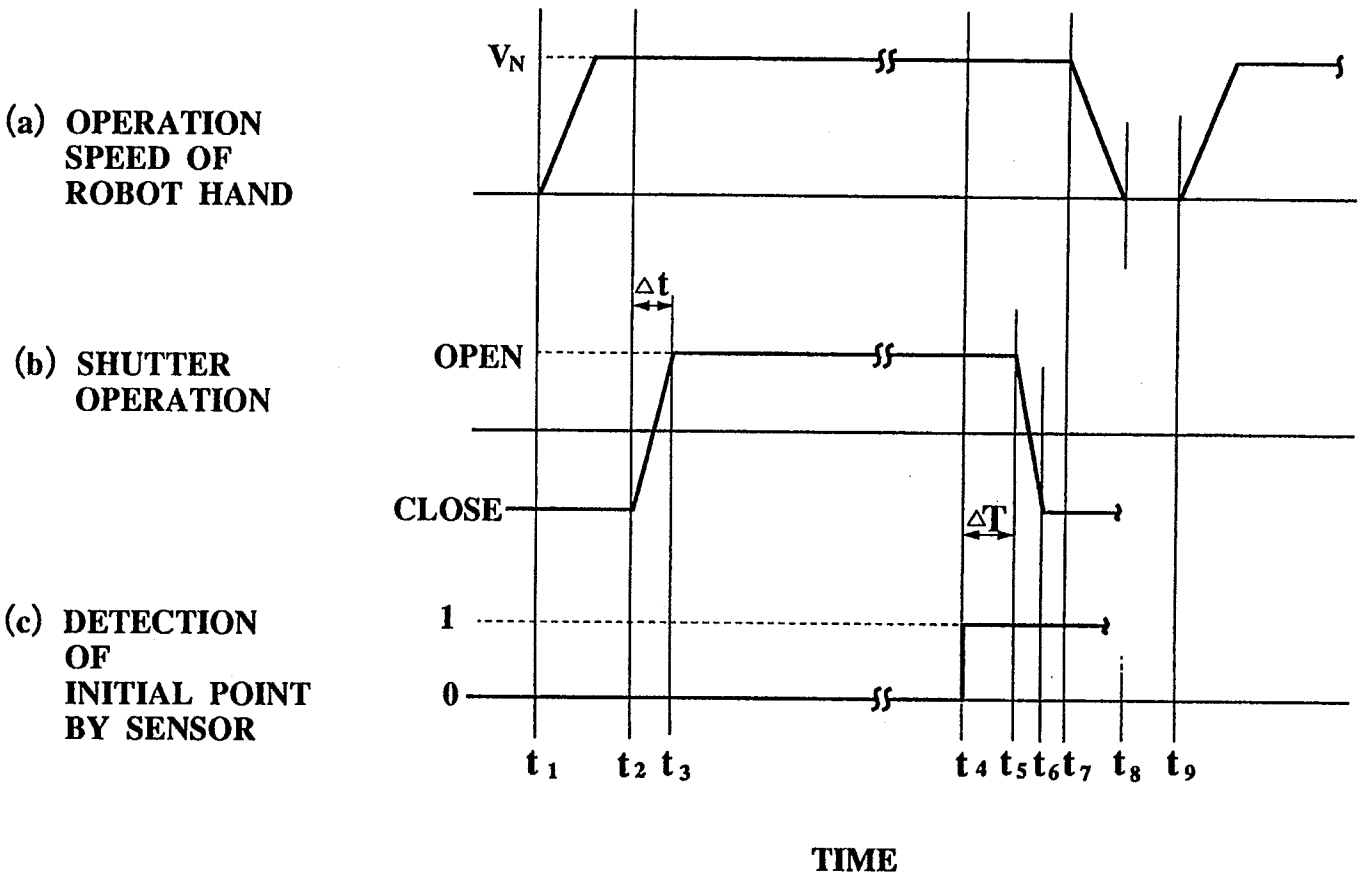
FIG. 13(*a*) through 13(*c*) are diagrammatic views showing relationship between an operation velocity of a robot hand, shutter operation and detection by a sensor.

FIG. 13 is a diagrammatic view showing a relationship between the operation speed (a) of the robot hand 28, operation (b) of the shutter plate 106 and detection (c) of the initial point by the sensor 58 for explanation of operation timing. In this drawing, the robot hand 28 begins to trace on an application track at a time $t_1$ from an origin which lies on the track, and a tracing speed increases and reaches to a constant value $V_N$. Next, the shutter plate 106 begins to open the injection port 52 at a time $t_2$ at which the viscous liquid in the sub-tank 24 begins to be injected from the injection port 52, and completes the opening at a time $t_3$. The moving velocity of the shutter plate 106 and the bore 114 relative to the injection port 52 being a definite value $V_{S1}$, a period $\Delta t$ ($=t_2-t_1$) which is necessary for completely opening the injection port 52 practically lies within a range of about 0.05 to 0.1 sec. During this period $\Delta t$, the sub-tank 24 and the injection port 52 cover a distance of $V_N \cdot \Delta t$, that is, a multiplication of the tracing speed $V_N$ of the sub-tank by the period $\Delta t$ for the open operation.

Figure 14:
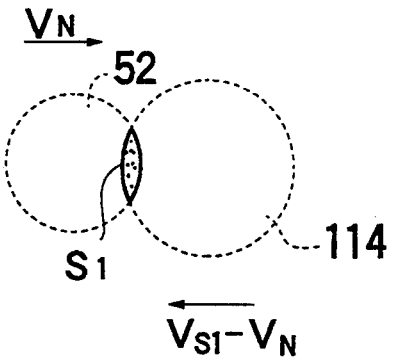
FIGS. 14(*a*) through 14(*c*) are illustrations showing an injection port of the apparatus of FIG. 10 during initial operation of the shutter device.
Figure 14:
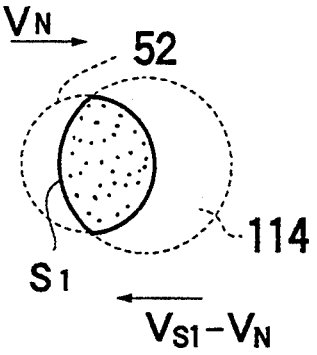
Figure 14:
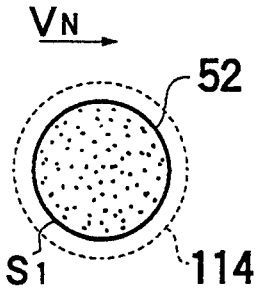

FIGS. 14(*a*), 14(*b*), 14(*c*), 15 and 16 illustrate initiation of the frit application achieved by the embodiment of the apparatus shown in FIG. 10.

Figure 15:
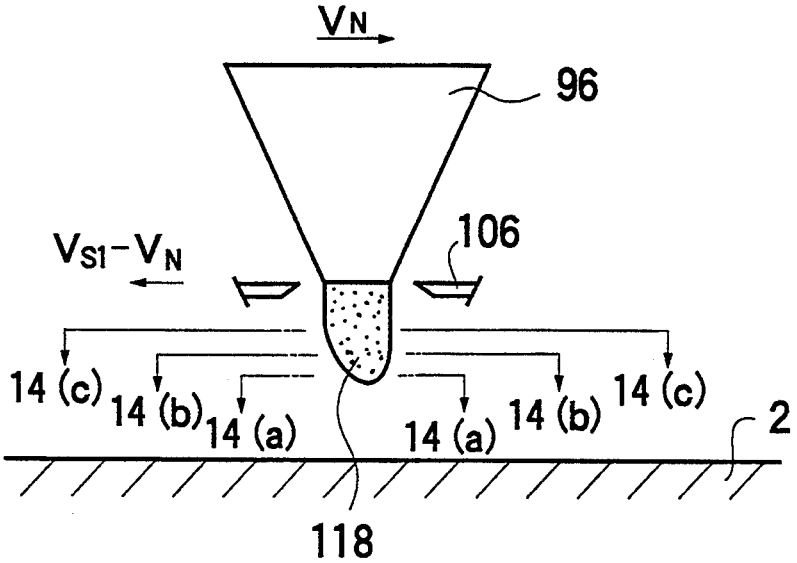
FIG. 15 is a schematic view showing initiation of injection by the apparatus of FIG. 10.
Figure 16:
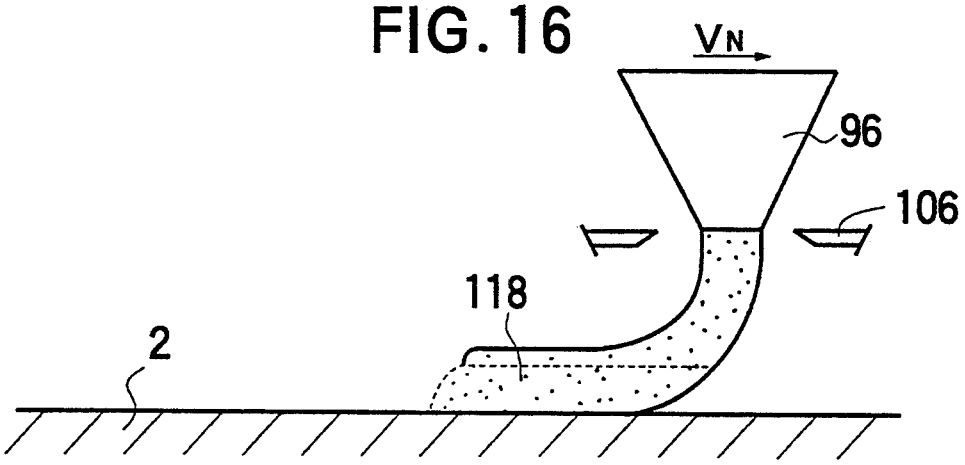
FIG. 16 is a schematic view showing initiation of application by the apparatus of FIG. 10.

In FIGS. 14(*a*) through (*c*), the shutter plate 106 with the bore 114 oppositely moves at the velocity $V_{S1}$ relative to the injection port 52 which travels at the velocity $V_N$. The shape of an opening $S_1$ made by the edges of the injection port 52 and the bore 114 changes through ones shown in FIGS. 14(*a*) and (*b*) to one in FIG. 14(*c*). Accordingly, a tip portion 118 of the injected frit, in theory, must be shaped corresponding to change of the opening, and it actually resembles to the shape shown in FIG. 15 especially when a viscosity of the liquid material is rather high. However, since liquid materials easily change shape any time in accordance with forces which works thereon, an actual shape of the injected frit may be varied from one which is shown in FIG. 15 according to many factors such as a viscosity, a density and a surface tension of the liquid, an injecting volume and the like. The tip portion 118 of the frit after injected reaches on the applied surface of the funnel 2 and makes a band of the frit on the surface, tracing on a track to be applied, as shown in FIG. 16.

Figure 17:
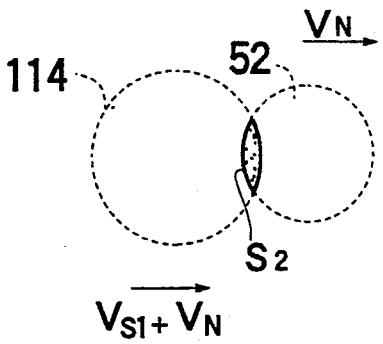
FIGS. 17(*a*) through 17(*c*) are illustrations showing an injection port of the apparatus of FIG. 11 during initial operation of the shutter device.
Figure 17:
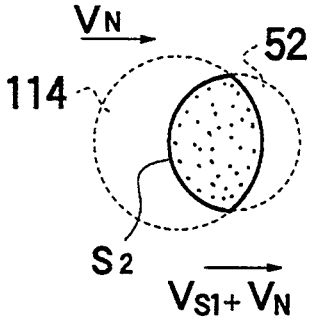
Figure 17:
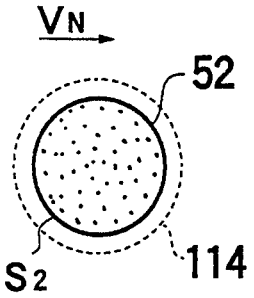

FIGS. 17(*a*), 17(*b*), 17(*c*) 18, and 19 show initiation of application achieved by the embodiment of the apparatus shown in FIG. 11.

Figure 18:
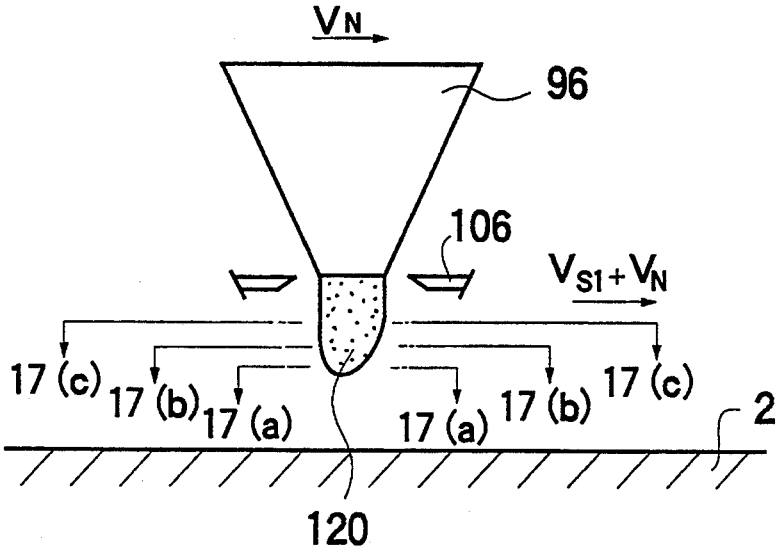
FIG. 18 is a schematic view showing initiation of injection by the apparatus of FIG. 11.

In FIGS. 17 (*a*) through (*c*), the injection port 52 which moves rightwards in the drawing at the velocity $V_N$, and the shutter plate 106 and the bore 114 move at the velocity $V_{S1}$ relative to the injection port 52 in the same direction as that in the injection port 52. The shape of an opening $S_2$ at the injection port 52 changes through ones shown in FIGS. 17(*a*) and (*b*) to one in FIG. 17(*c*). Accordingly, a tip portion 120 of the injected frit also must be shaped correspondingly as shown in FIG. 18. However, since a viscous liquid material easily changes the shape any time in accordance with forces which works thereon, an actual shape of the frit may be varied from one which is shown in FIG. 18 according to many factors such as a viscosity, a density and a surface tension of the liquid and the like.

Figure 19:
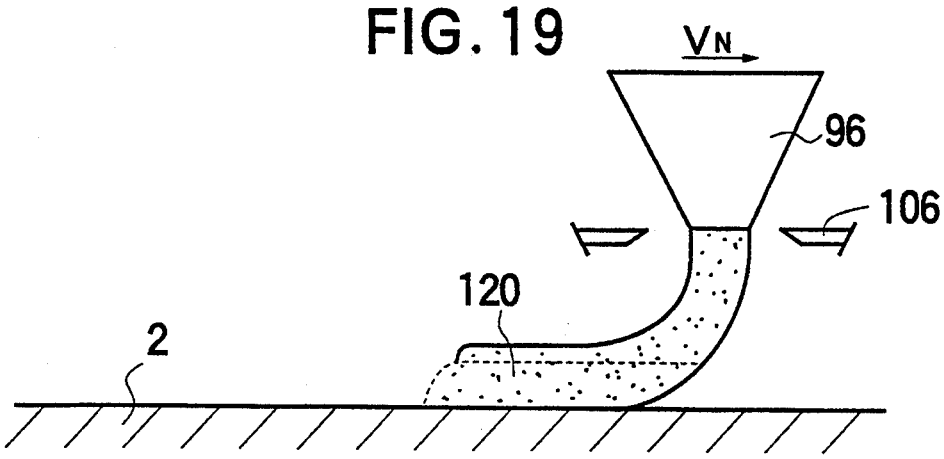
FIG. 19 is a schematic view showing initiation of application by the apparatus of FIG. 11.

In the above description, it may also be expected that the motion of the shutter plate 106 at the velocity of $V_{S1}$ affects the injection of the frit to incline the injected frit toward the direction in which the shutter plate moves, namely leftwards in FIG. 15 and rightwards in FIG. 18, respectively. However, this seems quite uncertain, because other factors also affect the results in a complicated manner. Moreover, the frit shape at the tip may change with time before the tip reaches on the funnel. In particular, during application process through which the injection port makes a loop and returns to the initial point of the frit band, the initial frit is somewhat deformed due to the weight of the frit itself to laterally spread and be flattened. Therefore, there would be found no longer a clear difference in shape of the initial portion between both cases described above, and any tip portion of the applied liquid has similarly an inclined and curved outline as shown by a broken line in FIGS. 16 and 19.

While the follow of the application track is continued, the band of the frit is drawn and extended uniformly, with being slightly spread laterally due to the weight of the frit.

Making a loop, the injection port 52 then approaches the initial point again from the opposite side of the initial point to the frit band lying. The sensor 58 detects presence of the initial portion of the frit band and signals to the shutter device at a time $t_4$ in FIG. 13. The shutter plate 106 begins to close the injection port 52 at a time $t_5$ that is later than the time $t_4$ by a period $\Delta T$ which is previously set by using a timer. Since a suitable period $\Delta T$ changes in accordance with location of the sensor 58, responsibility of the shutter plate 106, a distance between the injection port 52 and the surface to be applied and the like, it is preferred to be settled by making trial of application, correcting the period $\Delta T$ little by little and appropriately repeating them so that a tail portion of the injected frit suitably falls on the initial portion of the frit band to be joined together. The shutter plate 106 moves at a velocity of $V_{S2}$ relative to the injection port and completely close the injection port 52 at a time $t_6$. After that, motion of the robot hand 28 is decelerated at a time $t_7$ and completely stopped at a time $t_8$ to finish a cycle of application. Then, the treated funnel moves away and the next funnel comes up under the sub-tank along the production line, before another cycle of frit application starts at a time $t_9$.

Figure 20:
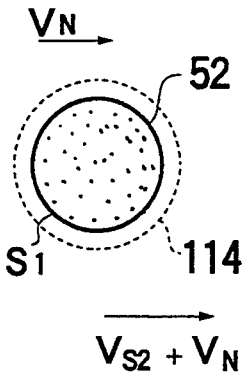
FIGS. 20(*a*) through 20(*c*) are illustrations showing the injection port of the apparatus of FIG. 10 during terminal operation of the shutter device.
Figure 20:
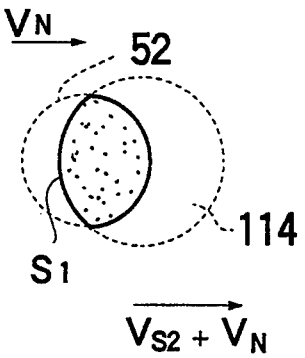
Figure 20:
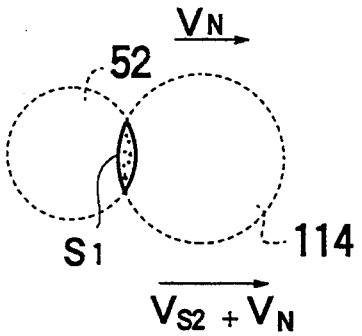
Figure 21:
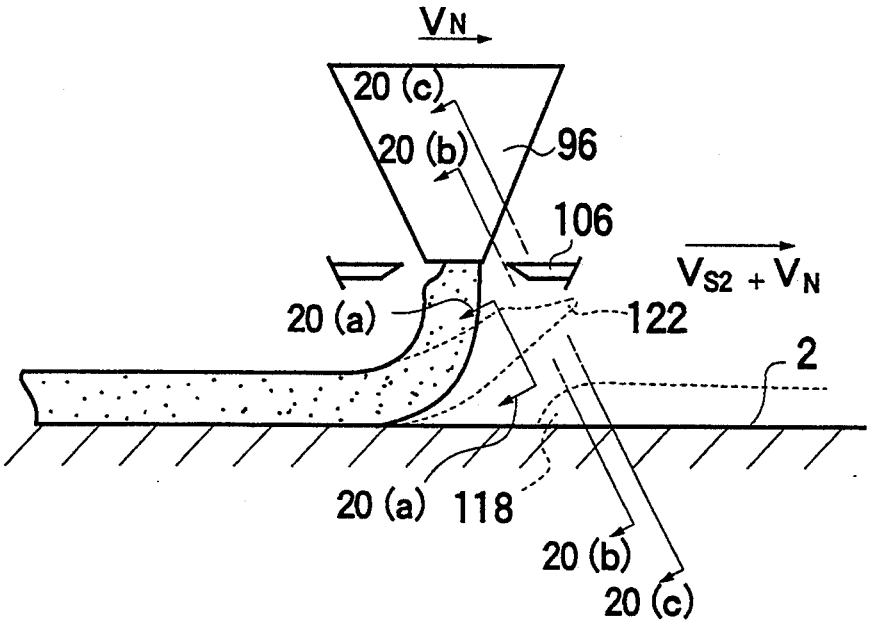
FIG. 21 is a schematic view showing termination of injection by the apparatus of FIG. 10.

FIGS. 20(*a*), 20(*b*), 20(*c*), 21 and 22 illustrate termination of tracing in the case of using the apparatus shown in FIG. 10. At the time $t_5$, the shutter plate 106 begins to close the injection port 52 in the forward direction, or in the same direction as that of the motion of the injection port 52, at a velocity $V_{S2}$ relative to the injection port 52, and the opening $S_1$ at the injection port 52 changes its shape from one shown in FIG. 20(*a*) through ones in FIGS. 20(*b*) and 20(*c*). Accordingly, a terminal portion 122 of the injected frit, in theory, is shaped correspondingly as shown in FIG. 21. The terminal portion 122 of the frit then falls on the initial portion 118 of the frit band, while being deformed by the weight of the frit, as shown in FIGS. 21 and 22 to be fused and .joined together with time.

Figure 22:
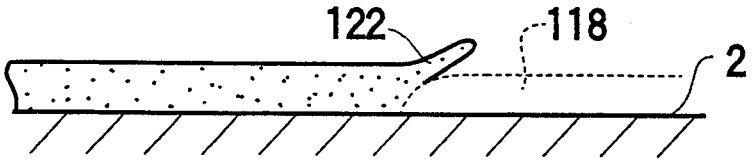
FIG. 22 is a schematic view showing termination of application by the apparatus of FIG. 10.

Of course, since liquid materials easily deform any time in accordance with forces which works thereon, an actual shape of the frit may be slightly varied from ones which are shown in FIGS. 21 and 22 according to differences in various factors such as a viscosity, a density and a surface tension of the liquid, an injecting volume and the like.

In the above case, the motion velocity $V_{S2}$ of the shutter plate 106 also can affect the results. Namely, due to viscosity of the liquid material and the like, the terminal end portion of the frit can be slightly attracted forwards by the shatter plate 106 moving forwards to be further tapered, so that a sectional view of the frit is smoothly thinned according to termination. This is considered to be advantageous in ease of joining of the both end portions and result in fine finishing of products.

Figure 23:
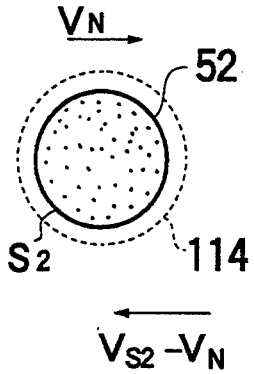
FIGS. 23(*a*) through 23(*c*) are illustrations showing an injection port of the apparatus of FIG. 11 during terminal operation of the shutter device.
Figure 23:
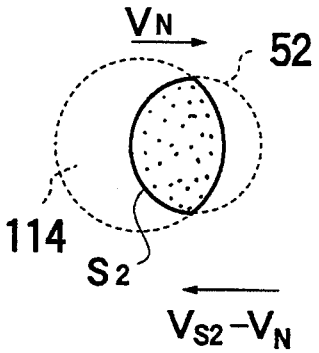
Figure 23:
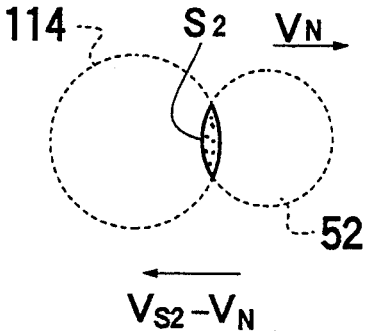
Figure 24:
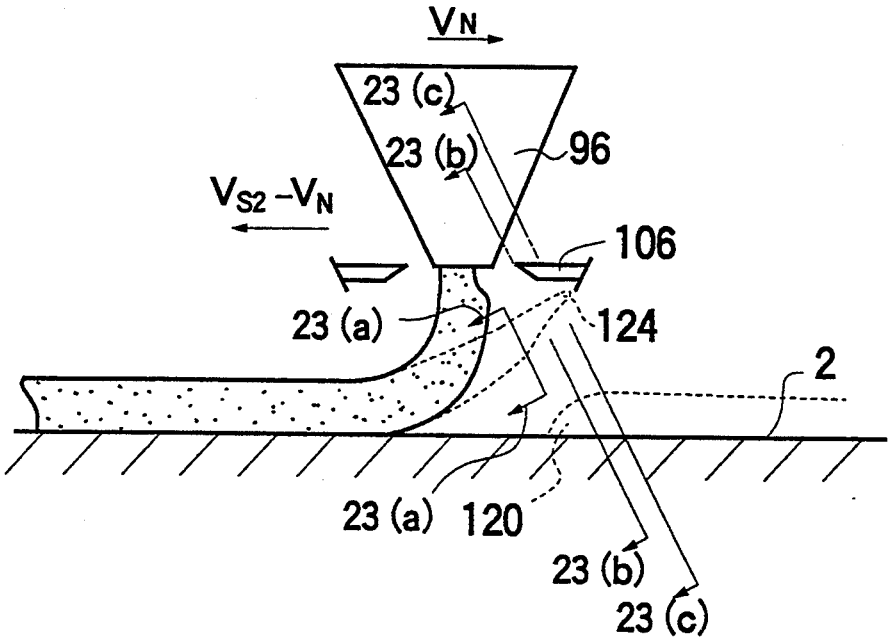
FIG. 24 is a schematic view showing termination of injection by the apparatus of FIG. 11.
Figure 25:
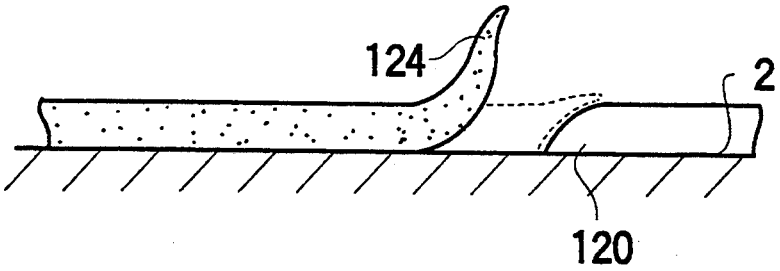
FIG. 25 is a schematic view showing termination of application by the apparatus of FIG. 11.

FIGS. 23(i a), 23(*b*), 23(*c*) 24 and 25 illustrate termination of tracing in the case of the apparatus shown in FIG. 11. At the time $t_5$, the shutter plate 106 begins to close the injection port 52 in the rearward direction, or the opposite direction to that of the motion of the injection port 52, at a velocity $V_{S2}$ relative to the injection port 52, and the opening $S_2$ at the injection port 52 changes its shape from one shown in FIG. 23(*a*) through ones in FIGS. 23(*b*) and 23(*c*). Accordingly, a terminal portion 122 of the injected frit is also shaped correspondingly as shown in FIG. 24. The terminal portion 122 of the frit then falls on the initial portion 120 of the frit band, while being deformed by the weight of the frit, as shown in FIGS. 24 and 25 to be fused and joined together with time. Here, for the same reason as described above, an actual shape of the frit may be slightly different from ones which are shown in FIGS. 24 and 25, similarly. Moreover, in this case, the motion velocity $V_{S2}$ of the shutter plate 106 is considered to affect the results so that the terminal portion of the frit is slightly attracted rearwards with the shatter plate 106 moving relatively rearwards, being bent slightly upwards. Therefore, a section of the frit is smoothly thinned according to termination, and additionally, a lower surface of terminal portion 124 of the frit curves so as to suite the upper curved surface of the initial portion 120 of the frit. As a result, the terminal portion 124 can easily merge into the initial portion 120.

Figure 26:
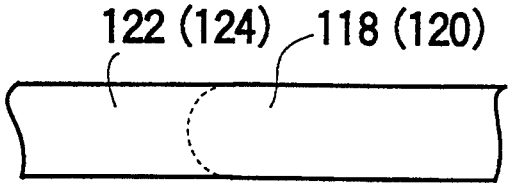
FIGS. 26(*a*) and (*b*) are a schematic plan view and a vertical sectional view showing a join of the initiation and the termination of a band of the applied frit.
Figure 26:
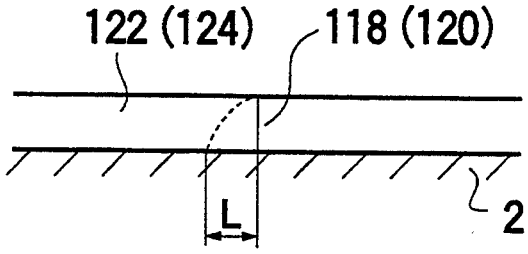

FIGS. 26(*a*) and 26(*b*) show a join of the initial and terminal portions of the frit band. As appeared in the drawings, the frit band formed by the apparatus according to the present invention is uniform, and the join of the frit band disappears a little later to be hardly seen with the naked eye. Even when it is watched carefully, at most, only a slightly raised portion can be found on the applied frit at a overlapping area L at which the initial portion and the terminal portion join together, as shown in FIG. 26(*b*). A volume of the raised portion changes according to a length of the overlapping area L, and the length of the area L can be controlled by appropriately regulating the period $\Delta T$ at setting of a timer. However, a volume change of the raised portion according to alteration of the period $\Delta T$ is rather small. Therefore, a small adjustment error of the length of the overlapping area L, or, of the period $\Delta T$ and the velocity $V_{S2}$ of the shutter plate described above, does not much affect the result, accordingly. In other words, severe adjustment is not required for the apparatus according to the present invention to set it for a preferred condition.

Figure 27:
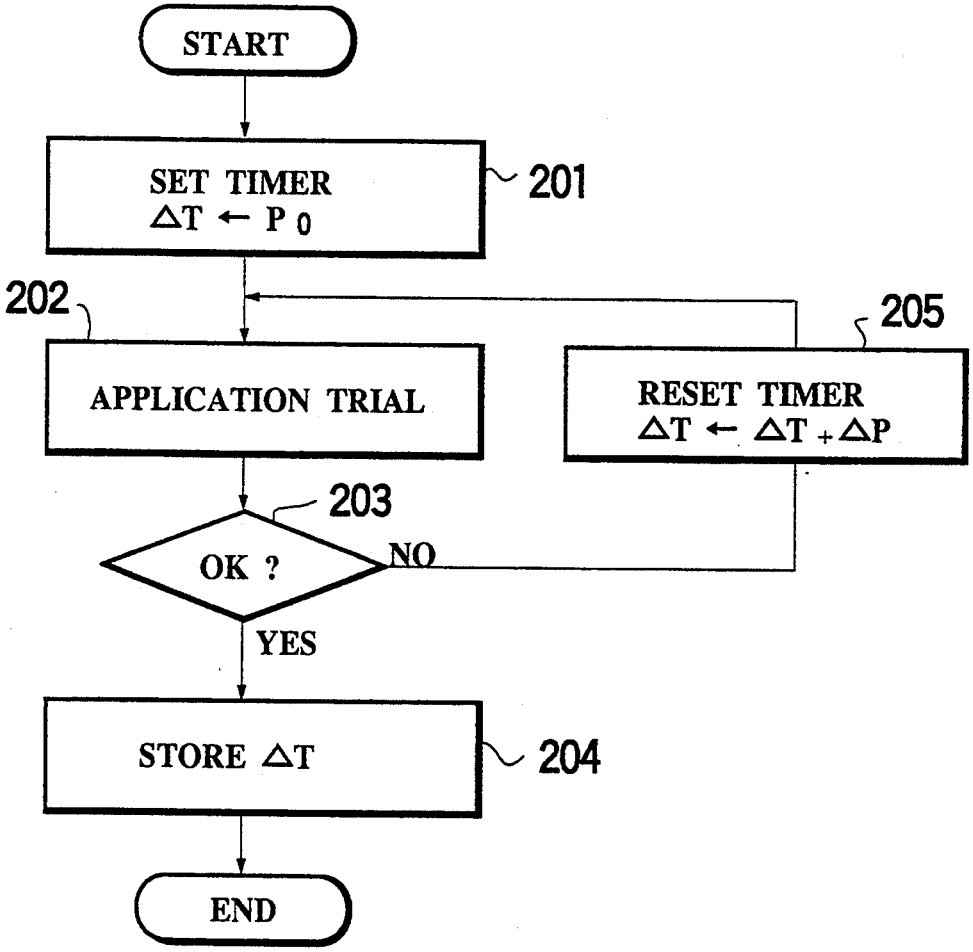
FIG. 27 is a flow sheet for explanation of determination of an operation condition of the apparatus according to the present invention.

FIG. 27 illustrates a method of adjusting the period $\Delta T$ to a suitable value by way of example. At the step 201, a digital timer is appropriately set for an initial value $P_0$ for the period $\Delta T$, and an application trial for the value $P_0$ is made at the step 202. Then, after observation of the result, it is judged at the step 203 if the result is satisfactory or not. If the judgement is yes, the period $\Delta T$ is determined to the present value $\Delta T(=P_0)$ and stored in a memory device at the step 204. If the judgement is no, a variation $\Delta P$ is added to the present value of the period $\Delta T$ $(=P_0)$ and the timer is set for the new period $\Delta T$ $(=P_0+\Delta P)$. Then, the application trial and resetting of the timer are repeated by n times until a satisfactory result can be obtained for a renewed $\Delta T(n)$ $(=P_0+n\Delta P, n\geqq 0)$. The variation $\Delta P$ can be preferably selected within a range of 1 to 10 msec. and a range of $-10$ to $-1$ msec. The above operation can be managed by using a computer-automated system so that an initial value for the period $\Delta T$ is automatically selected by various application conditions such as properties of the liquid material, a dimension and a shape of the injection port and the like.

Moreover, the motion velocity $V_S$ of the shutter plate 106 can be freely changed by controlling an air pressure which works in the air cylinder 98 as necessity arises. If the velocity $V_S$ is raised, the length of the tapered portion of the injected frit at the initiation or termination is shortened. On the other hand, since the sectional shape of the injected frit can be changed in accordance with the shape of the injection port, the shape of the tapered end portion of the frit also can be regulated by modifying the injection port.

In the above embodiments, the apparatus is used for applying a frit to a funnel. However, it is, of course, possible to utilize the apparatus for other application works such as application of a sealant to a sheet glass and the like.

In the above embodiments, if the edge of the injection port and the shutter plate are coated with anti-blocking agent, it is possible to decrease influence of the moving shutter on the injected viscous liquid material, so that shapes of the initial and terminal portions of the injected material can be accurately controlled by suitably selecting a value for the motion speed $V_S$ of the shutter and shapes for the injection port and the bore of the shutter plate.

As described above, an injecting amount and a sectional shape of the corded liquid material can be correctly controlled by the shutter plate which is arranged on the injection port to move across the injecting direction according to the present invention, therefore, the apparatus for applying a viscous liquid material of the present invention can be utilize as not only a frit coater and an adhesive applier but also an applying machine for other viscous liquid materials, such as fluid semisolid materials which is creamy, syrupy, solated or the like.

It must be understood that the invention is in no way limited to the above embodiments and that many changes may be brought about therein without departing from the scope of the invention as defined by the appended claims.

What is claimed is:

1. An apparatus for applying a viscous liquid material, comprising:

a nozzle being substantially disposed along a vertical axis and having a port for downwardly discharging the viscous liquid material;

a shutter member shiftably arranged at said port for opening and closing said port so that an initial end and a terminal end of a stream of viscous liquid material being discharged from said port are defined by the opening and closing of said port, respectively;

motion means for controllably moving said nozzle so as to trace a predetermined closed track on a substantially horizontal underlying surface with said stream of viscous liquid material being discharged from said port; and shift means for controllably shifting said shutter member between first and second positions so that said terminal end of said stream of discharged viscous liquid material on said surface overlaps said initial end of said stream, and such that said shutter member is shifted in opposite directions perpendicular to said axis and parallel to said track between said first and second positions.

2. The apparatus of claim 1, wherein said shutter member includes a substantially thin plate horizontally disposed.

3. The apparatus of claim 1, wherein said shutter member has an acute edge such that said acute edge can sharply divide said stream of the discharged viscous liquid material from said port, while said shutter member closes said port.

4. The apparatus of claim 3, wherein said shutter member has a covering surface with which said port is covered, and said acute edge is formed on an end of the covering surface.

5. The apparatus of claim 3, wherein said shutter member has a bore for passing the discharged viscous liquid material therethrough, and the acute edge is formed around the bore.

6. The apparatus of claim 5, wherein said bore has a dimension which is slightly larger than said port.

7. The apparatus of claim 6, further comprising a guide plate on which said shutter member can slide to shift, and said guide plate has an aperture for passing said discharged viscous liquid material.

8. The apparatus of claim 1, further comprising a first container and a second movable container for containing the viscous liquid material, wherein said first and second containers are connected to one another so as to controllingly charge the viscous liquid material from said first container to said second container, and said nozzle is arranged on said second movable container.

9. The apparatus of claim 8, wherein the second movable container includes means for pressuring the liquid material in the second container at a preset level of pressure to constantly discharge the liquid material from said nozzle.

10. The apparatus of claim 1, wherein said shutter member is shifted opposite to said direction to which said nozzle is moved when said shutter member closes said port.

11. The apparatus of claim 1, wherein said shutter member is shifted in a similar direction to said direction to which said nozzle is moved when said shutter member closes said port.

12. A method of applying a viscous liquid material to a predetermined closed track on a substantially horizontal underlying plane, using an apparatus comprising a nozzle having a port for discharging said viscous liquid material and a shutter member shiftably arranged at said port for opening and closing said port, comprising said steps of:

disposing said nozzle above said underlying plane with said port directed downwards along a vertical axis;

opening said port of said nozzle to continuously discharge a stream of said viscous liquid material from said port, said stream having an initial end;

moving said nozzle so as to trace said closed track with said stream of viscous liquid material; and closing said port by shifting said shutter member to interrupt said stream of said viscous liquid material to form a terminal end so that said terminal end overlaps said initial end of said stream, wherein said shutter member is shifted in opposite directions perpendicular to said axis and parallel to said track between said first and second positions.

13. The method of claim 12, wherein at the closing step, said shutter member is shifted opposite to the direction to which said nozzle is moved on said path.

14. The method of claim 12, wherein at the closing step, said shutter member is shifted correspondingly to the direction to which said nozzle is moved on said path.

15. The method of claim 12, wherein at the closing step, an acute edge formed on said shutter member breaks in said discharged viscous liquid material.

* * * * *